US008007596B2

(12) United States Patent
Hammond et al.

(10) Patent No.: US 8,007,596 B2
(45) Date of Patent: Aug. 30, 2011

(54) CLEANING DEVICE HAVING DRIVE MEANS WITH MULTIPLE DRIVING MODES

(75) Inventors: Geoffrey Robert Hammond, Hull (GB); Lawrence T. Levine, Fairfield, CT (US); Lamson Nguyen, Somerset, NJ (US)

(73) Assignee: Reckitt Benckiser (UK) Limited, Berkshire (GB)

( * ) Notice: Subject to any disclaimer, the term of this patent is extended or adjusted under 35 U.S.C. 154(b) by 646 days.

(21) Appl. No.: 10/597,550

(22) PCT Filed: Feb. 1, 2005 (Under 37 CFR 1.47)

(86) PCT No.: PCT/GB2005/000343
§ 371 (c)(1), (2), (4) Date: Oct. 1, 2008

(87) PCT Pub. No.: WO2005/074332
PCT Pub. Date: Aug. 11, 2005

(65) Prior Publication Data

US 2009/0277476 A1 Nov. 12, 2009

(30) Foreign Application Priority Data

Feb. 18, 2004 (GB) ..... 0403537.4

(51) Int. Cl.
*A47L 11/00* (2006.01)
*A47L 11/10* (2006.01)

(52) U.S. Cl. ..... 134/18; 134/21; 15/49.1; 15/319; 15/340.1; 15/354

(58) Field of Classification Search ..... 15/49.1, 15/319, 340.1, 340.4, 354
See application file for complete search history.

(56) References Cited

U.S. PATENT DOCUMENTS 5,309,592 A * 5/1994 Hiratsuka ..... 15/49.1
5,771,987 A 6/1998 Marbach
5,815,880 A * 10/1998 Nakanishi ..... 15/319

FOREIGN PATENT DOCUMENTS

DE 18 13 880 A1 7/1970
DE 1813880 * 7/1970
FR 1 320 130 A 3/1963
GB 2 266 060 A 10/1993
WO 02/067745 A1 9/2002

OTHER PUBLICATIONS

English Translation of DE-1813880.*

(Continued)

*Primary Examiner* — Michael Barr
*Assistant Examiner* — Saeed T Chaudhry
(74) *Attorney, Agent, or Firm* — Norris, McLaughlin & Marcus, P.A.

(57) ABSTRACT

A cleaning device (10) incorporates drive means (14) and cleaning means (20), wherein the drive means (14) are operable to drive the cleaning means (20) across a surface to be cleaned, and wherein the drive means (14) are operable to adopt first and second driving modes, the first driving mode being a travelling mode and the second driving mode being a turning mode, wherein locking means (40, 42) of the drive means (14) allow selection between the first and second driving modes.

16 Claims, 3 Drawing Sheets

OTHER PUBLICATIONS

Combined Search and Examination Report from The Patent Office in Great Britain dated Jul. 9, 2004 for application GB 0403537.4.
International Search Report dated May 3, 2005 for application PCT/GB2005/000343.
Written Opinion of the International Searching Authority for application PCT/GB2005/000343.
WPI abstract accession No. 2003-760622 [72] & JP 2003280740 [Matsushita]—Feb. 10, 2003.
WPI abstract accession No. 2003-642158 [61] & JP 2003241835 [Matsushita]—Aug. 29, 2003.
International Preliminary Report on Patentability dated Aug. 22, 2006 for application PCT/GB2005/000343.

* cited by examiner

44

46

CLEANING DEVICE HAVING DRIVE MEANS WITH MULTIPLE DRIVING MODES

This is an application filed under 35 USC 371 of PCT/GB2005/000343.

This invention relates to a cleaning device, a method of driving a cleaning device, a method of cleaning and a drive mechanism for a cleaning device.

A number of automatic cleaning devices are known that are used to clean a floor by automatically moving around that floor as a cleaning operation is undertaken. Some devices operate by mapping out the floor space of a room to be cleaned by means of complex electronics that store a plan of the room to be cleaned and direct the cleaning device to work around the planned room. Such complex automatic devices have the disadvantage of being expensive to manufacture. Also, the devices of this type are prone to requiring frequent maintenance and have high power requirements.

Another type of automatic cleaning device does not incorporate complex electronic circuitry and takes a random path across a floor surface of a room to be cleaned with the intention that, by the random nature of the path, the entire floor surface will at some point have been covered by the cleaning device. Disadvantages arise with this type of device in that the random path taken can result in much repetition of the surface being cleaned, unless action is taken to prevent this type of behaviour.

Furthermore, both types of automatic cleaning device have the disadvantage of becoming stuck in relatively narrow spaces or corners within the room to be cleaned.

It is an object of the present invention to address the above-mentioned disadvantages. It is a further object to the present invention to provide a cleaning device having a mode of operation that results in a controlled random movement across a surface to be cleaned.

According to a first aspect of the invention a cleaning device incorporates drive means and cleaning means, wherein the drive means are operable to drive the cleaning means across a surface to be cleaned, and wherein the drive means are operable to adopt first and second driving modes, the first driving mode being a travelling mode and the second driving mode being a turning mode, wherein locking means of the drive means allow selection between the first and second driving modes.

The drive means may include a rotatably mounted carriage, which preferably incorporates at least one drive wheel. The carriage is preferably mounted to rotate about an axis substantially perpendicular to a rotational axis of the at least one drive wheel. The carriage is preferably prevented from rotating in the first driving mode. The carriage is preferably free to rotate in the second driving mode.

The locking means are preferably operable to be actuated by the cleaning device making contact with an obstacle. The locking means are preferably actuable by an activation element located on a periphery of the cleaning device. The activation element may be a bumper, which may protrude from the cleaning device. The activation element may be physically, preferably rigidly, linked to the locking means. The activation element may be electrically linked to the locking means.

The locking means may be detent means. The detent means may comprise an interengaging projection/recess pair of the carriage and a body of the cleaning device.

Preferably, the locking means are biased to cause engagement of the first driving mode, preferably by a resilient bias. Preferably, the resilient bias is arranged to be overridden by the cleaning device making contact with an obstacle, such as by a physical jolt.

The turning mode may be a manoeuvring mode.

The drive means may provide a rear wheel drive.

According to a second aspect of the invention a method of driving a cleaning device comprises adopting one of first and second driving modes of drive means of the cleaning device, wherein the first driving mode is a travelling mode and the second driving mode is a turning mode, and wherein the first and second driving modes are selected by actuation of locking means of the drive means.

The locking means are preferably actuated by the cleaning device making contact with an obstacle, which contact may be an impact.

Actuation of the locking means preferably results in the second driving mode being adopted. In the absence of actuation of the locking means the first driving mode is preferably selected.

Preferably the locking means are biased to lock a carriage of the drive means in position in the first driving mode. Preferably an impact between the cleaning device and an obstacle causes disengagement of the locking means.

Selection of the second driving mode preferably allows a carriage of the drive means to turn about a generally vertical axis. The turning of the carriage preferably allows the carriage to find a driving direction that avoids the obstacle that caused the selection of the second driving mode. The carriage preferably turns to a first direction that at least one driving wheel of the drive means can drive the cleaning device.

According to a third aspect of the invention a method of cleaning a surface comprises driving a cleaning device across the surface with drive means, to thereby cause cleaning means of the cleaning device to pass over the surface to allow cleaning thereof, wherein the drive means drive the cleaning device in a substantially straight path in a first driving mode until an obstruction is encountered, whereupon a second driving mode is engaged that causes the drive means to turn or reverse from the obstacle.

The invention extends to cleaning means for a cleaning device as described in the first aspect.

The invention extends to drive means for a cleaning device as described in the first aspect.

According to a further aspect of the invention a cleaning device incorporates drive means for driving the cleaning device across a surface to be cleaned and cleaning means, wherein a front face of the cleaning device is substantially straight and a rear face of the cleaning device is substantially curved, preferably giving the cleaning device a general D-shape.

The cleaning means are preferably located substantially adjacent to the front face on an underside of the cleaning device.

The drive means may be located in a front section of the cleaning device, or may be located in a rear section of the device.

All of the features described herein can be combined with any of the above aspects in any combination.

For a better understanding of the invention, and to show how embodiments of the same may be carried into effect, reference will now be made, by way of example, to the accompanying diagrammatic drawings in which.

Figure 4:
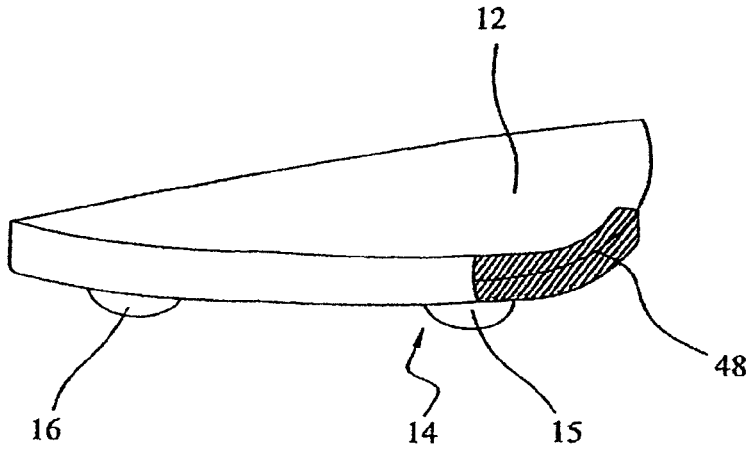
FIG. 4 is a schematic perspective view of the floor cleaning device.

A cleaning device 10 comprises a body section 12, having a drive mechanism 14 with slave wheels 16 and 18, which may be jockey wheels or may be ball bearings. A cleaning section 20 is located on a base of the body section 12. The device is shown schematically in FIG. 4.

The cleaning section 20 may be a dry duster pad or it may be a wet cleaning device, which may be fed with cleaning fluid or water from a reservoir. The cleaning section 20 may driven in a spinning motion. The cleaning section 20 is replaceable and or replenishable.

The drive mechanism 14 incorporates wheels 15 joined by axle 22. The axle 22 and wheels 15 are held within a carriage 36, from which housing a lower part of each wheel 15 projects. The carriage is on an eccentric, freely rotatable mounting (shown at point 17 in FIG. 1) to allow rotation about a generally vertical axis. The mounting is slightly forward of the centre of the carriage, so that in forward motion the main portion of the carriage will be dragged behind the eccentric mounting. Internal projections 24 and 26 in the housing 36 provide snap fit retaining clips for the axle 22, said clips allowing free rotation of the axle 22

The axle 22 includes a toothed wheel 28, which engages a toothed wheel 30 secured to a drive shaft 32 of a motor 34.

Figure 2:
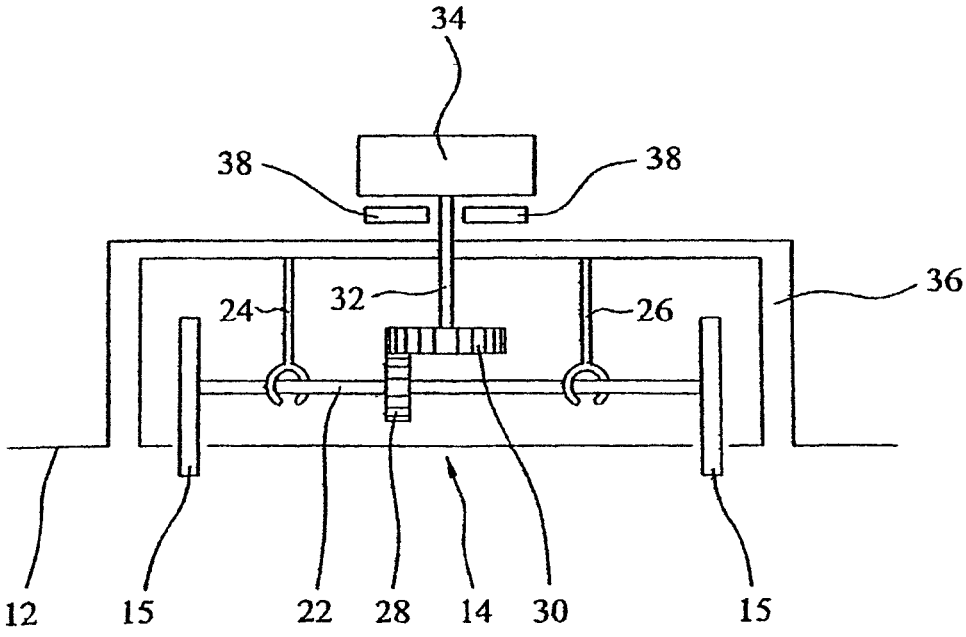
FIG. 2 is a schematic partial cross-sectional view of a drive mechanism of the floor cleaning device.

The motor 34 is housed in the body 12 of the cleaning device 10, separate from the carriage 36. The drive shaft 32 extends from the body 12 into the carriage 36, as shown in FIG. 2.

Figure 3:
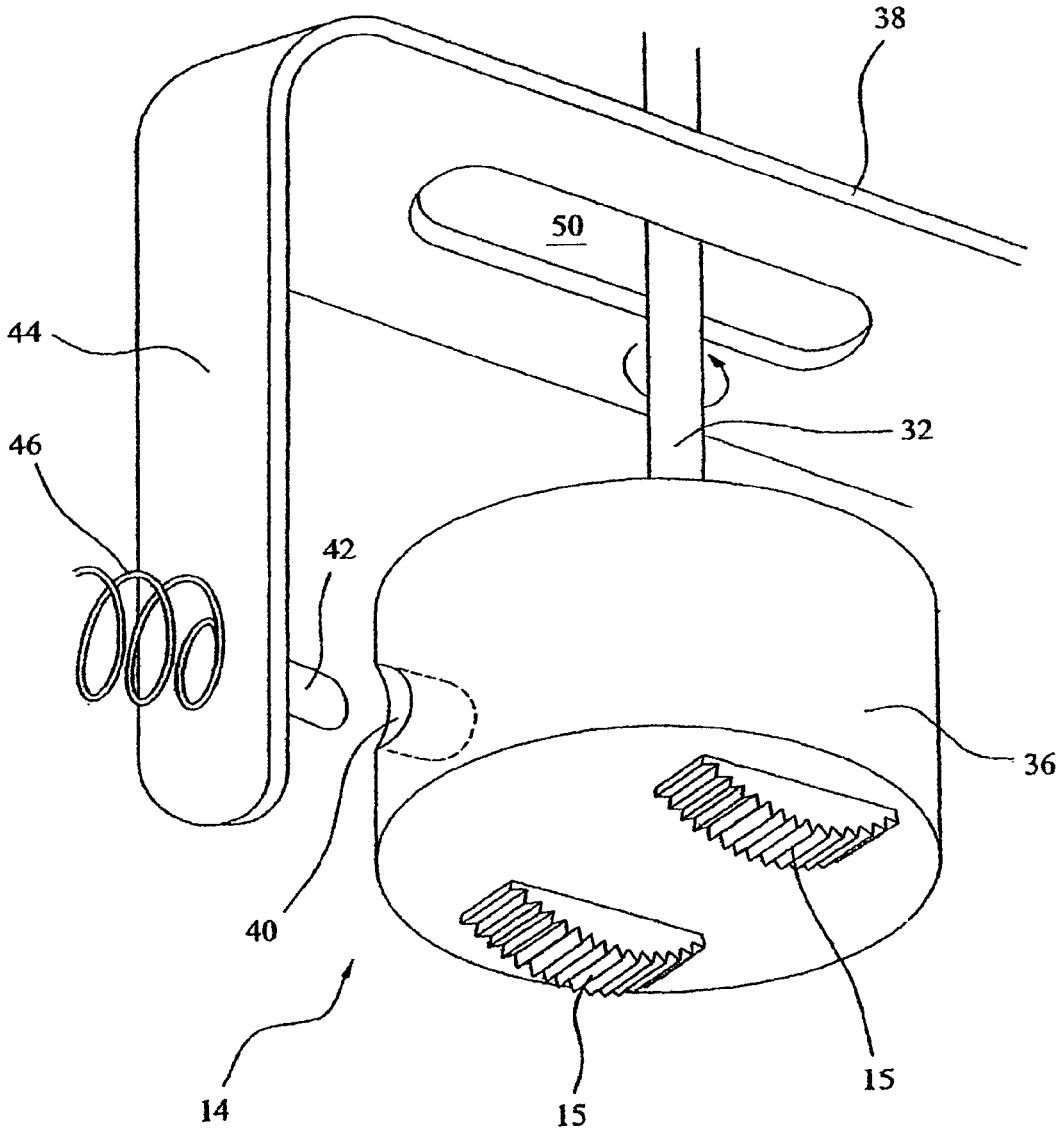
FIG. 3 is a partial schematic perspective view of the drive mechanism of the floor cleaning device.

As shown in FIG. 3, the carriage 36 incorporates an opening 40 on a rear outer face thereof, which opening 40 is adapted to receive a projection 42 of a drive mode selection bracket 44. The drive mode selection bracket 44 is biased forwards by a spring 46 to urge the projection 42 towards the carriage 36 and into the opening 40 in the carriage 36, assuming the carriage 36 is correctly aligned with the projection 42, as will be described below. The drive mode selection bracket 44 is connected to a plate 38 which extends horizontally forwards over the top of the carriage 36 to a bumper 48 (see FIG. 1) which projects forwards out of the body 12 of the cleaning device 10. The bumper 48, the plate 38 and drive mode selection bracket 44 are all biased forwards by the spring 46. An opening 50 is provided in the plate 38 to allow the drive shaft 32 to pass between the carriage 36 and the motor 34.

The height of a lower edge of the bumper 48 from the ground is a relevant factor to consider. The height must be sufficiently great that the bumper 48 is not triggered by a surface that is only uneven, rather than being an obstruction, but the bumper must be sufficiently low that it does not pass over the top of an obstruction. A clearance of about 3 mm has been found to be acceptable. The bumper 48 has an upper edge extending to the top of the body 12 of the cleaning device 10, so that the bumper is triggered in the event that an overhanging obstruction is hit, such as a spar of a chair or the like.

In use, the motor 34 drives the drive shaft 32 causing rotation of the toothed wheel 30. The toothed wheel 30 rotates about a generally vertical axis as shown in FIG. 2. Engagement of the toothed wheel 28 and the toothed wheel 30 converts the vertical rotational axis to a generally horizontal rotational axis, suitable for driving the wheels 15. The toothed wheel 28 is rigidly mounted on the axle 22, meaning that rotation of the toothed wheel 28 causes rotation of the wheels 15 which, when the cleaning device 10 is placed on a floor, causes the cleaning device 10 to be driven forwards, assuming sufficient torque and power is provided by the motor 34.

In an initial operating condition in the bumper 48, plate 38 and drive mode selection bracket 44 are urged forwards by the spring 36 so that the projection 42 engages the opening 40 in the carriage 36. The cleaning device 10 will be driven in a forwards direction. The carriage 36 is freely rotatable on its eccentric mounting about the drive shaft 32, but the engagement of the projection 42 and the opening 40 prevent rotation of the carriage 36. In this drive mode, the cleaning device is driven forwards.

Should the cleaning device 10 make contact with an obstacle, such as a wall or a piece of furniture, as it is being driven along a floor the bumper 48 will be pushed back slightly towards the body 12 causing the plate 38 and selection bracket 44 move backwards against the bias of the spring 46. This causes the projection 42 to be withdrawn from the opening 40 in the carriage 36.

A feature of the carriage 36 (which as mentioned above is freely rotatable about the drive shaft 38) is that in the absence of the wheels 15 being able to turn because of an obstacle the carriage 36 is caused to rotate in the direction dictated by the rotation of the drive shaft 32 until the wheels 15 can turn once more. The reason for rotation of the carriage 36 is that the turning force of the power shaft 32 is more easily dissipated than it would be if the motor 34 were simply to stall. Thus, the least resistance is typically provided by rotation of the wheel 15.

For example, if the obstruction is a wall forward motion of the cleaning device 10 is prevented causing the wheels 15 either to cease rotation or spin without traction. At the same time, with the projection 42 being removed from the opening 40 the carriage 36 is allowed to turn in response to rotation of the drive shaft 32. Thus, the carriage 36 turns until it can pull the cleaning device 10 in a direction away from or along an edge of the obstruction, for example to the side. On a normal floor surface and in the absence of an obstruction the torque of the motor is more easily dissipated by rotation of the wheels 15 than by rotation of the carriage 36. This then results in the cleaning device moving in a new direction.

Given the eccentric mounting of the carriage 36, the carriage 36 tends to assume a forwards direction of movement, because the weight of the carriage is dragged behind the pivot 17. This leads to realignment of the projection 42 with the opening 40. The spring 46 then urges the projection 42 back into the opening 40 and the carriage 36 is locked in forward drive mode. Thus the cleaning device 10 proceeds until a new obstruction is encountered.

During the period when the projection 42 is disengaged from the opening 40 the carriage 36 simply rotates until an orientation is found in which the wheels 15 can turn. Thus, the carriage 36 effectively attempts all possible directions of movement until the first possible direction of drive is encountered. The carriage 36 always rotates in the direction of rotation of the drive shaft 32. Thus, for a clockwise rotation of the drive shaft, as shown schematically by the arrow in FIG. 3, the carriage 36 turns around clockwise to attempt to find a direction of travel to move away from the obstacle.

It has been found that the cleaning device 10 may perform a three point turn when encountering an obstacle. If there is friction between the bumper 48 and the obstacle, the first available direction of movement may be in reverse. If this is the case the cleaning device reverses and after a short period of travel with the drive mechanism 14 acting in the manner of a rear wheel drive device, the cleaning device turns around through about 90 degrees and the carriage turns again to resume a forward travel direction.

An alternative embodiment of cleaning device 10 incorporates all of the features of the first embodiment except for the mechanical linkage of the bumper 48 through the plate 38 to the drive mode selection bracket 44. Instead, a pressure switch or piezo-electric device takes the place of the bumper 48, which switch or piezoelectric device is electrically connected to a solenoid or the like which, when triggered, causes a projection much the same as that as shown by reference numeral 42 in FIG. 3 to engage the opening 40 in the carriage 36. The projection is biased forwards to lock the carriage 36 by a spring or the like, as described in relation to the first embodiment. The projection 42 and recess 40 work in the same way as described above in relation to FIG. 3, except that instead of a mechanical linkage, the linkage is electrical.

Figure 1:
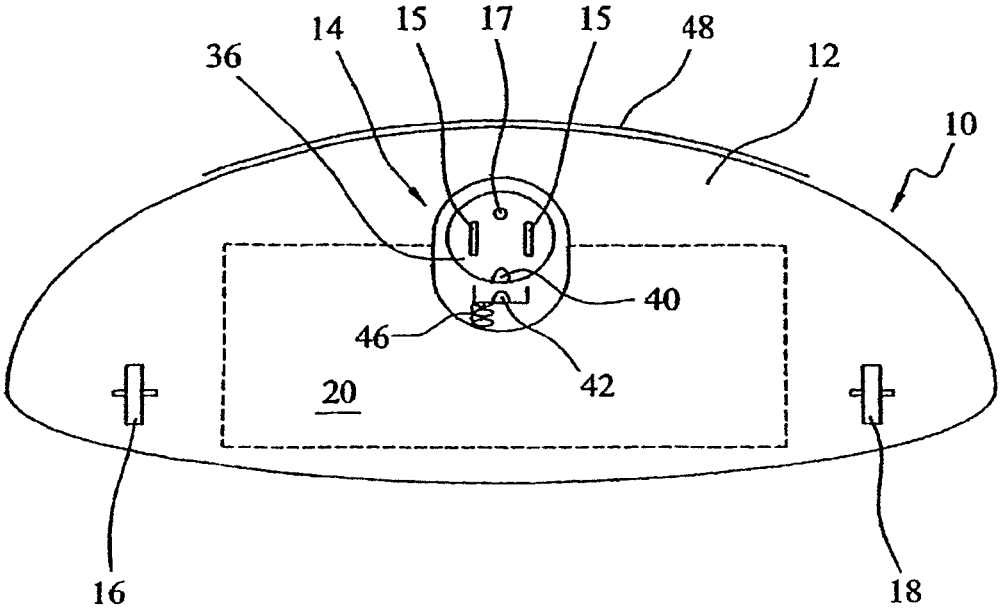
FIG. 1 is a schematic view of an underside of an automatic floor cleaning device.

As shown in FIG. 1, the plan view of the cleaning device 10 shows that it has a general D shape, with a curved front face and a generally straight rear. It has been found that this shape is particularly beneficial in assisting the cleaning device from freeing itself from an obstruction, such as a wall, more particularly a corner or a obstruction caused by furniture or other items located on the floor being cleaned. Furthermore, the location of the carriage 36 close to the curved front face of the cleaning device assists the turning of the cleaning device 10 away from an obstruction, in that the curved front face allows the cleaning device to turn more easily away from an obstruction. An angle or corner on the front face may prevent the cleaning device 10 from rotating with respect to an obstacle.

Figure 5:
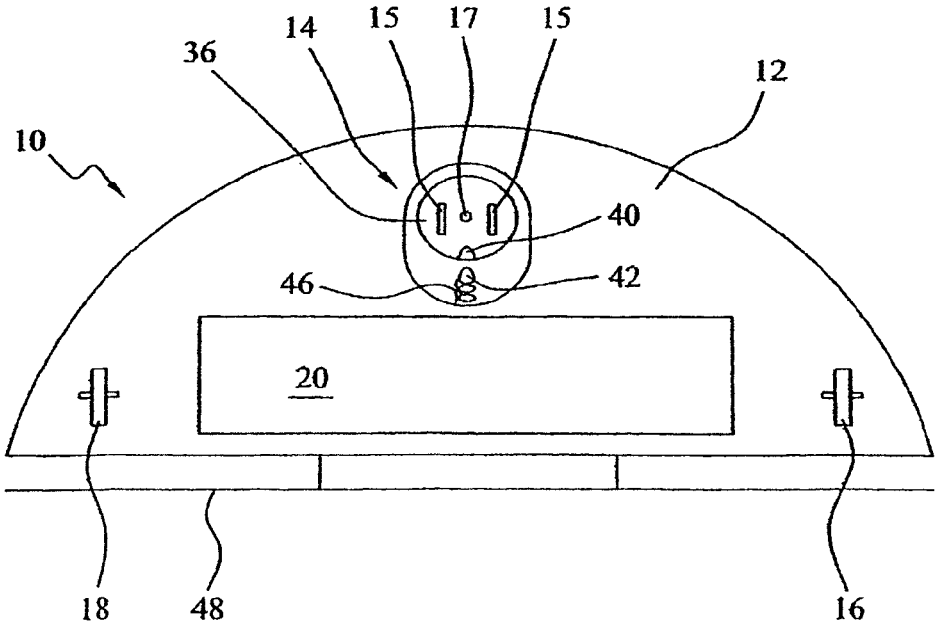
FIG. 5 is a schematic view of an underside of a second embodiment of cleaning device.

FIG. 5 shows a different embodiment of cleaning device. All of the parts are common with the embodiment shown in FIGS. 1 to 4, but the orientation of the body section 12 is reversed, so that cleaning device 10 has a straight front edge and a curved rear. Also, the drive mechanism 14 is located towards the rear of the cleaning device 10, to provide a rear wheel drive, compared to the front wheel drive of the embodiment of FIGS. 1 to 4. Instability of the drive mechanism 14 due to rear wheel drive does not occur, because the carriage 36 is locked in position during forward motion, as described above. It has been found that better cleaning of an edge of a floor and corners, or around objects, is achieved with a straight front face. The reason for this is that the flat front face can approach closer to an edge than the curved face. The same reference numerals are used in FIG. 5 as those in FIGS. 1 to 4. The device functions in the same way as the embodiment of FIGS. 1 to 4.

The cleaning devices described herein have significant advantages resulting from the drive carriage 36 being either retained in position or released depending on a particular drive mode, such as either a forward driving mode or a turning mode. The disadvantages of a poorly aligned or weighted system in which the cleaning device moves in a curved path is avoided by having the carriage 36 locked in position until an obstruction is encountered. It has been found that a straight path leads to a floor being cleaned more quickly when compared to a cleaning device moving in a tightly curved path.

Furthermore, significant advantages are derived from the shape of the device having a front curved edge to assist in a device driving itself out of or away from obstructions.

Also, the embodiment having a straight front edge has advantages.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A cleaning device comprising drive means and cleaning means, wherein the drive means are operable to drive the cleaning means across a surface to be cleaned, and wherein the drive means are operable to adopt first and second driving modes, the first driving mode being a travelling mode and the second driving mode being a turning mode, wherein locking means of the drive means allow selection between the first and second driving modes, and the locking means are operable to be actuated by an activation element located on a periphery of the cleaning device making contact with an obstacle, or the locking means of the drive means are biased to cause engagement of the first driving mode.

2. A cleaning device as claimed in claim 1, in which the drive means includes a rotatably mounted carriage incorporating at least one drive wheel.

3. A cleaning device as claimed in claim 2, in which the carriage is mounted to rotate about an axis substantially perpendicular to a rotational axis of the at least one drive wheel.

4. A cleaning device according to claim 2 in which the carriage is prevented from rotating in the first driving mode.

5. A cleaning device according to claim 2 in which the carriage is free to rotate in the second driving mode.

6. A cleaning device as claimed in claim 1, in which the activation element is electrically linked to the locking means.

7. A cleaning device according to claim 1 in which the locking means are detent means.

8. A cleaning device as claimed in claim 7, in which the detent means comprise an interengaging projection/recess pair of the carriage and a body of the cleaning device.

9. A cleaning device as claimed in claim 1, in which the bias is arranged to be overridden by the cleaning device making contact with an obstacle.

10. A cleaning device according to claim 1 further comprising a front face and a rear face wherein said front face of the cleaning device is substantially straight and said rear face of the cleaning device is substantially curved.

11. A method of driving a cleaning device comprises adopting one of first and second driving modes of drive means of the cleaning device, wherein the first driving mode is a travelling mode and the second driving mode is a turning mode, and wherein the first and second driving modes are selected by actuation of locking means of the drive means and wherein the locking means are operable to be actuated by an activation element located on a periphery of the cleaning device making contact with an obstacle, or the locking means of the drive means are biased to cause engagement of the first driving mode.

12. A method as claimed in claim 11, in which the locking means are actuated by the cleaning device making contact with an obstacle.

13. A method according to claim 11 in which actuation of the locking means results in the second driving mode being adopted.

14. A method according to claim 11 in which, in the absence of actuation of the locking means, the first driving mode is selected.

15. A method according to claim 11 in which the locking means are biased to lock a carriage of the drive means in position in the first driving mode.

16. A method according to claim 11 in which selection of the second driving mode allows a carriage of the drive means to turn about a vertical axis.

* * * * *